United States Patent [19]

Albertson et al.

[11] Patent Number: 5,036,824

[45] Date of Patent: Aug. 6, 1991

[54] FUEL INJECTION

[75] Inventors: William C. Albertson, Sterling Heights; George E. Pospiech, Washington; Louis H. Weinand, Troy, all of Mich.

[73] Assignee: General Motors Corporation, Detroit, Mich.

[21] Appl. No.: 369,510

[22] Filed: Jun. 21, 1989

[51] Int. Cl.[5] ..... F02M 69/08; F02M 55/00; F02M 67/02

[52] U.S. Cl. ..... 123/531; 123/456

[58] Field of Search ..... 123/456, 470, 531, 532, 123/533, 534

[56] References Cited

U.S. PATENT DOCUMENTS

| | | | |
|---|---|---|---|
| 4,082,224 | 4/1978 | Magnus | 239/453 |
| 4,693,224 | 9/1987 | McKay | 123/531 |
| 4,753,213 | 6/1988 | Schlunke et al. | 123/533 |
| 4,759,335 | 7/1988 | Ragg et al. | 123/531 |
| 4,771,754 | 9/1988 | Reinke | 123/532 |
| 4,794,902 | 1/1989 | McKay | 123/533 |
| 4,841,942 | 6/1989 | McKay | 123/533 |
| 4,926,806 | 5/1990 | Ahern et al. | 123/531 |
| 4,934,329 | 6/1990 | Lear et al. | 123/531 |
| 4,934,346 | 6/1990 | Olson | 123/532 |
| 4,962,745 | 10/1990 | Ohno et al. | 123/533 |

FOREIGN PATENT DOCUMENTS

| | | |
|---|---|---|
| 2182978 | 5/1987 | United Kingdom . |
| 8700584 | 1/1987 | World Int. Prop. O. . |

*Primary Examiner*—Tony M. Argenbright
*Assistant Examiner*—Robert E. Mettes
*Attorney, Agent, or Firm*—C. K. Veenstra

[57] ABSTRACT

A fluid rail assembly supports a fuel metering injector and a charge delivery on an engine. The charge delivery injector includes flutes spaced about the interior of the nozzle to promote formation and delivery of a charge of fuel and air having desired spray characteristics. The fluid rail body includes passages that provide air to assist in delivering fuel from the fuel metering injector to through the charge delivery injector to the engine, the passages being constructed to inhibit back flow of fuel therethrough.

4 Claims, 3 Drawing Sheets

FUEL INJECTION

TECHNICAL FIELD

This invention relates to an assembly adapted to deliver a fuelair charge directly into an engine combustion chamber

DETAILED DESCRIPTION

Figure 1:
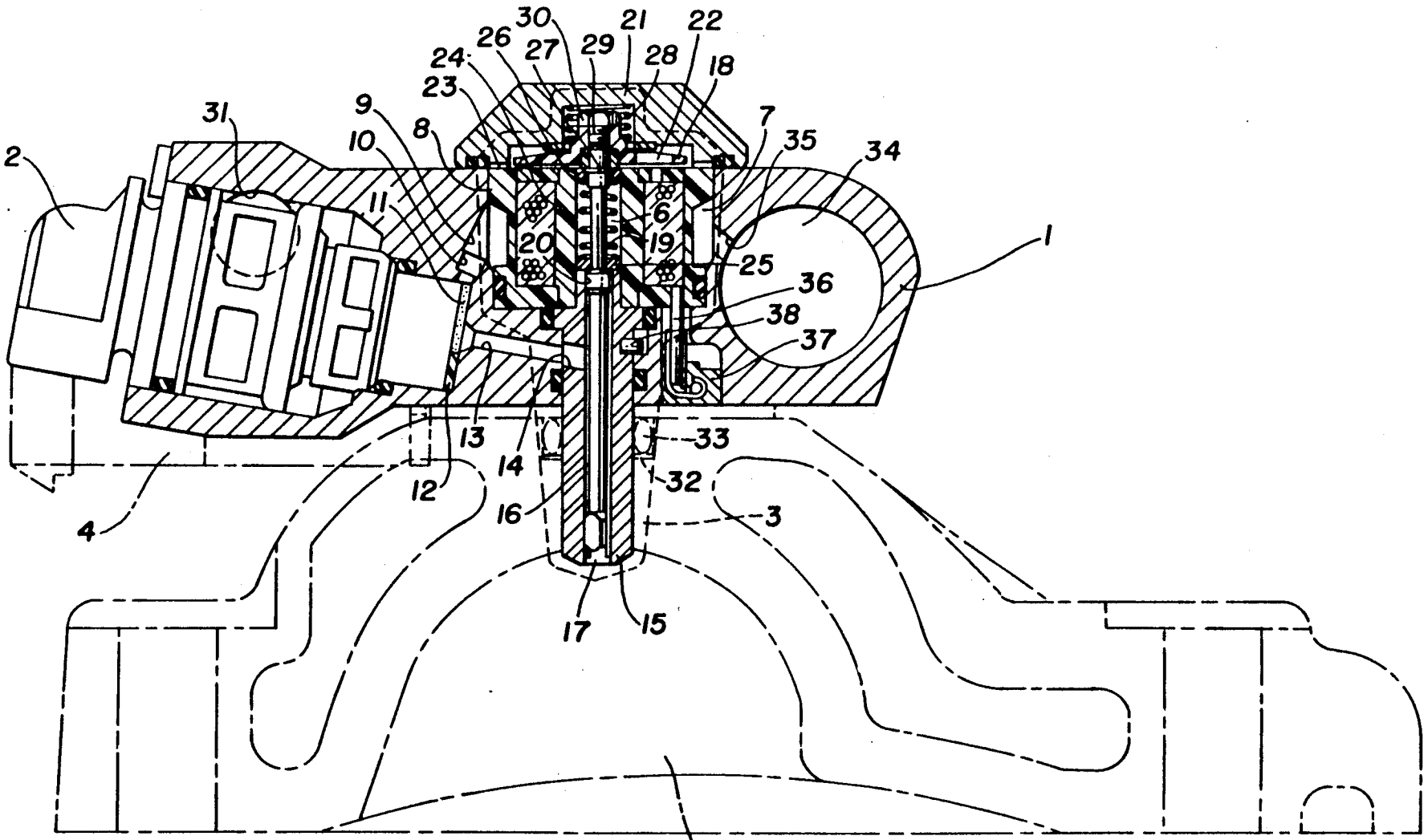
FIG. 1 is a transverse sectional view of a fluid rail mounted on an engine cylinder head, showing an injector for delivering a charge of fuel and air directly into one of the engine combustion chambers, and showing an injector for metering fuel to the charge delivery injector.

Referring first to FIG. 1, a fluid rail assembly has a fluid rail body 1 that supports fuel metering injectors 2 and charge delivery injectors 3 and associated electrical wiring and connectors 4 on an engine so each injector 3 may deliver a charge of fuel and air to its associated combustion chamber 5.

Rail body 1 has a longitudinal air supply passage 6 aligned with the charge delivery injectors 3. Passage 6 supplies air to a peripheral air supply passage or channel 7 surrounding the housing 8 of the solenoid coil assembly in each charge delivery injector 3. Each channel 7 supplies air to a drilled air supply passage 9 containing a cup restrictor 10 that provides a calibrated orifice in passage 9. Each passage 9 supplies air to an air space 11 between the end of the associated fuel metering injector 2 and body 1; each air space 11 is a wedge-shaped volume that is not occupied by a generally C-shaped elastomeric gasket 12 sandwiched between the end of the associated fuel metering injector 2 and body 1. A drilled passage 13 connects each air space 11 to an aperture 14 in the nozzle 15 of the associated charge delivery injector 3. Within each injector 3, aperture 14 opens into a region 16 surrounding the stem of its valve 17.

Each injector 2 delivers metered fuel through its air space 11 and passage 12 to the aperture 14 of the associated charge delivery injector 3, and through aperture 14 into the region 16 of injector 3. When the solenoid coil of that charge delivery injector 3 is energized, its armature 18 is attracted against the bias of a return spring 19 to open valve 17. Air flow from passage 6 through channel 7, passage 9, air space 11, passage 13, aperture 14 and region 16 then delivers the fuel into the associated combustion chamber 5.

A secondary air flow path allows air upwardly through the clearance space between the outer diameter of each solenoid coil housing 8 and the rail body 1, radially inwardly through slots 23 in the base of the cover 21 into the cavity surrounding armature 18, downwardly through apertures 22 in the armature 18 into the cavity surrounding return spring 19, and downwardly through an annular orifice 20 between the valve stem and the top of nozzle 15 into region 16. The secondary air flow though orifice 20 is a small percent of the air flow through the orifice in restrictor 10, but is sufficient to purge any fuel that may migrate into the secondary air flow path.

For ease of assembly and service, each charge delivery injector 3 can be installed and removed as a unit from the fluid delivery rail body 1. The solenoid coil assembly is secured to the nozzle 15 by press fitting the nozzle 15 within the core 24 of the solenoid coil assembly. O-rings above and below passage 13 and aperture 14 seal against migration of fuel between nozzle 15 and fluid rail body 1 while permitting a sliding clearance between nozzle 15 and fluid rail body 1 that allows easy installation and removal of charge delivery injector 3.

Within each injector 3, a C-shaped washer 24 fits about the stem of valve 17 and rests on the top of nozzle 15 to provide a seat for return spring 19. Washer 25 has an inner diameter smaller than the upper end of the stem of valve 17 in order to capture valve 17 if the upper spring retainer 26 or the associated lock ring 27 break.

Return spring 19 is calibrated by selecting a washer 25 of appropriate thickness, or by selecting an armature spring 28 of appropriate force. Travel of valve 17 is calibrated by adjusting set screw 29 to position armature 18 at the desired distance above the top of the solenoid coil assembly, and employing nut 30 to lock set screw 29 in place.

Certain details of the structure at the top of charge delivery injectors 3 are set forth in US patent application G-3313 filed concurrently in the name of L. W. Weinand; the disclosure of that application is incorporated by reference.

The position of the fuel metering injectors 2 relative to the charge delivery injectors 3 was selected to minimize the overall height of the fluid rail assembly. Fuel is supplied to the fuel metering injectors 2 by a longitudinal passage 31 that intersects the sockets for injectors 2. Fuel supply passage is located above fuel metering injectors 2 to permit easy exit of any vapor generated within the injectors or injector sockets.

Because the fluid rail body 1 is solid and the charge delivery injectors 3 are rigidly secured in the body 1, the spacing between injectors 3 is not adjustable. This requires accurate control of the spacing between the holes in the cylinder heads that receive nozzles 15. To accommodate mounting of the fluid rail assembly on the engine without excessively tight machining tolerances, the openings around nozzles 15 are larger than when the spacing between injectors 3 is adjustable, and a copper washer 32 and an O-ring 33 seal the opening about each nozzle 15. Washer 32 protects O-ring 33 against direct exposure to combustion chamber gases, and conducts heat away from the O-ring. Washer 32 has an interference fit on nozzle 15 and a clearance fit within the O-ring groove in the top of the head. When injector 3 is installed, nozzle 15 deforms the inner portion of washer 32 into a conical shape, thereby effecting a tight seal.

The orifice in each restrictor 10 inhibits back flow of fuel into passage 9. In addition, the offset of passages 9 (about 90 degrees) from passage 6 inhibits back flow of fuel into the air supply passage 6. In the absence of provisions to inhibit such back flow, fuel might be transferred from the fuel metering injector 2 associated with one combustion chamber 5 to the charge delivery injector 3 associated with another combustion chamber 5; in that event, fuel would be unevenly distributed among the combustion chambers 5.

An auxiliary air reservoir 34 extends longitudinally through fluid rail body 1. A plurality of drilled passages 35 connect reservoir 34 to the air supply channels 7 that surround the solenoid coil assemblies of the charge delivery injectors 3. In some applications, reservoir 34 may provide the sole air supply to channels 7, replacing air supply passage 6. Because reservoir 34 is connected to channels 7 through passages 35, and because passages 35 are offset about 180 degrees from passages 9, use of reservoir 34 as the sole air supply to channels 7 would further inhibit the possibility that fuel might be transferred from the fuel metering injector 2 associated with one combustion chamber 5 to the charge delivery injector 3 associated with another combustion chamber 5.

The solenoid coil assembly of each charge delivery injector 3 has terminals 36 that exit at the bottom of the solenoid coil housing 8 and are connected by insulated wires to electrical connector 4. If desired, a terminal block 37 may be employed to connect the wires to terminals 36.

A pin 38 carried by nozzle 15 is received in a slot in body 1 to assure that nozzle aperture 14 is aligned with body passage 13.

Figure 2:
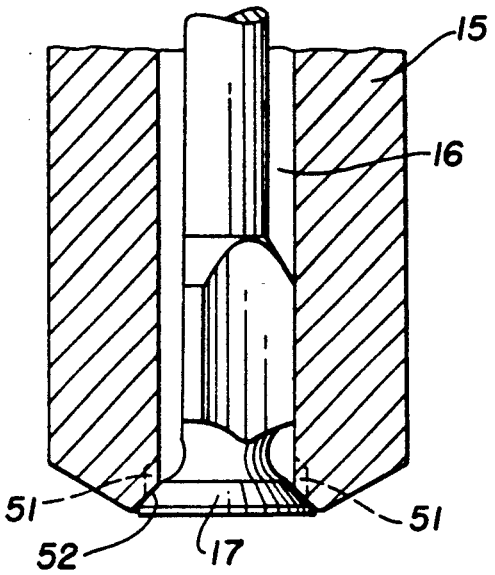
FIG. 2 is an enlarged sectional view of a portion of the FIG. 1 charge delivery injector, showing internal flutes provided to generate an advantageous injector spray pattern.
Figure 3:
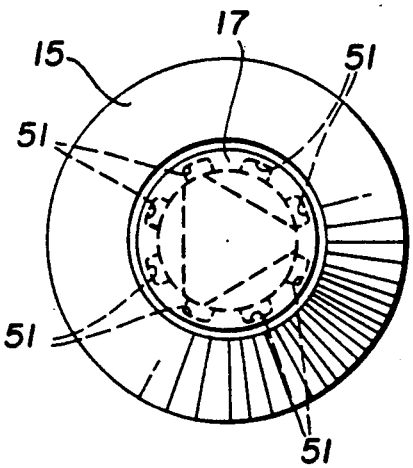
FIG. 3 is an end view of the FIG. 2 injector.

As shown in FIGS. 2–3, nozzle 15 has internal flutes 51 spaced about the inside of the nozzle at the bottom of region 16. Flutes 51 promote filling in of the initially hollow spray pattern created by nozzle 15 and valve 17. That effect is believed to be due to the fact that tapered surfaces 52 of different lengths are exposed at the bottom of nozzle 15 when valve 17 is opened; the longer tapered surfaces between flutes 51 create a greater pressure drop than the shorter tapered surfaces at the ends of flutes 51; the different length surfaces 52 accordingly generate adjacent fuel streams of differing velocities that promote turbulence and mixing which, in turn, fills the hollow cone to produce a more uniform spray density.

Flutes 51 are not exposed to the combustion products in combustion chamber 5 and accordingly are not readily susceptible to plugging. Moreover, the diverging surfaces on nozzle 15 and the head of valve 17, in combination with the lack of crevices on the outside of nozzle 15, discourages formation of deposits that could migrate.

As shown in FIG. 1, the stem of valve 17 is guided in nozzle 15 by the upper portion of nozzle 15 and the triangular portion of the valve stem near the head of valve 17. This construction assures good alignment of the head of valve 17 and the mating or sealing portions of surfaces 52 at the end of nozzle 15 to effect a tight seal therebetween.

Figure 4:
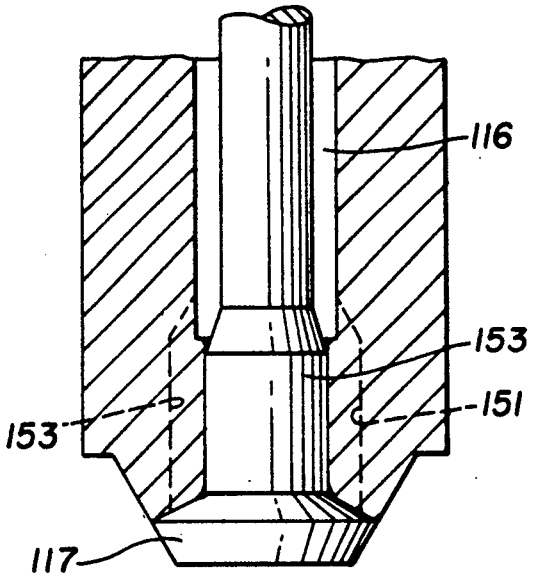
FIG. 4 is an enlarged sectional view similar to FIG. 2 of another charge delivery injector, showing alternative internal flutes provided to generate an advantageous injector spray pattern.
Figure 5:
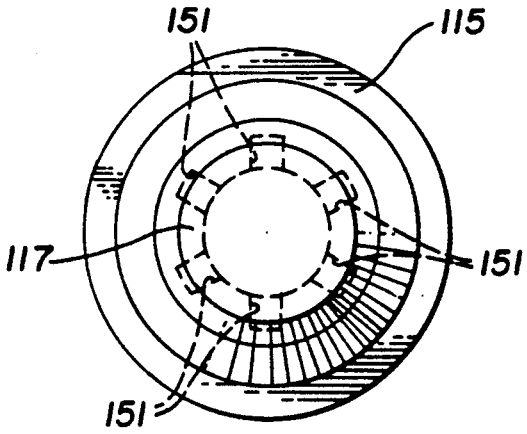
FIG. 5 is an end view of the FIG. 4 injector.

As shown in FIGS. 4–5, the stem of another valve 117 has a cylindrical boss 153 instead of the triangular portion of valve 17. Boss 153 is guided in the associated nozzle 115, and flutes 151 extend past boss 153 to deliver the fuel from the region 116 surrounding the stem of valve 117 within nozzle 115. Flutes 151 also promote filling in of spray pattern created by nozzle 115 and valve 117.

Figure 6:
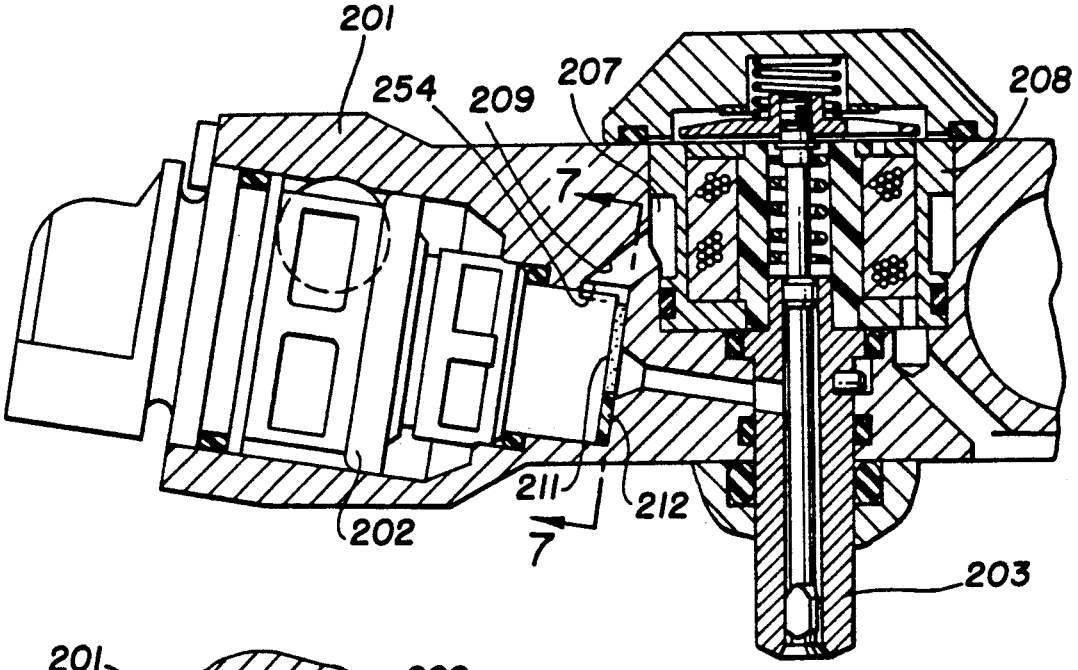
FIG. 6 is a sectional view similar to FIG. 1 of another fluid rail, showing an alternative air supply construction.
Figure 7:
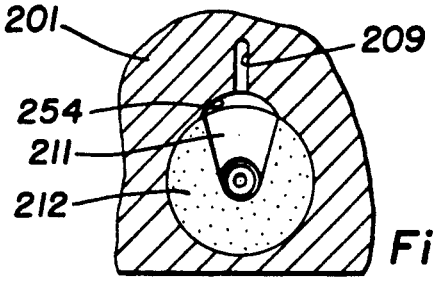
FIG. 7 is a sectional view, taken along line A—A of FIG. 6, showing further details of the alternative air supply construction.

FIGS. 6–7 illustrate another fluid rail body 201 in which an axially extending groove 254 connects the air space 211 (at the end of the fuel metering injector 202) with the drilled air supply passage 209 that extends from the air supply channel 207 surrounding the housing 208 of the solenoid coil assembly in the charge delivery injector 203. As in the FIG. 1 embodiment, air space 211 is the wedge-shaped volume that is not occupied by the generally C-shaped elastomeric gasket 212 sandwiched between the end of fuel metering injector 202 and body 201. Other details of the FIG. 2 fluid rail assembly are similar to the FIG. 1 embodiment.

Figure 8:
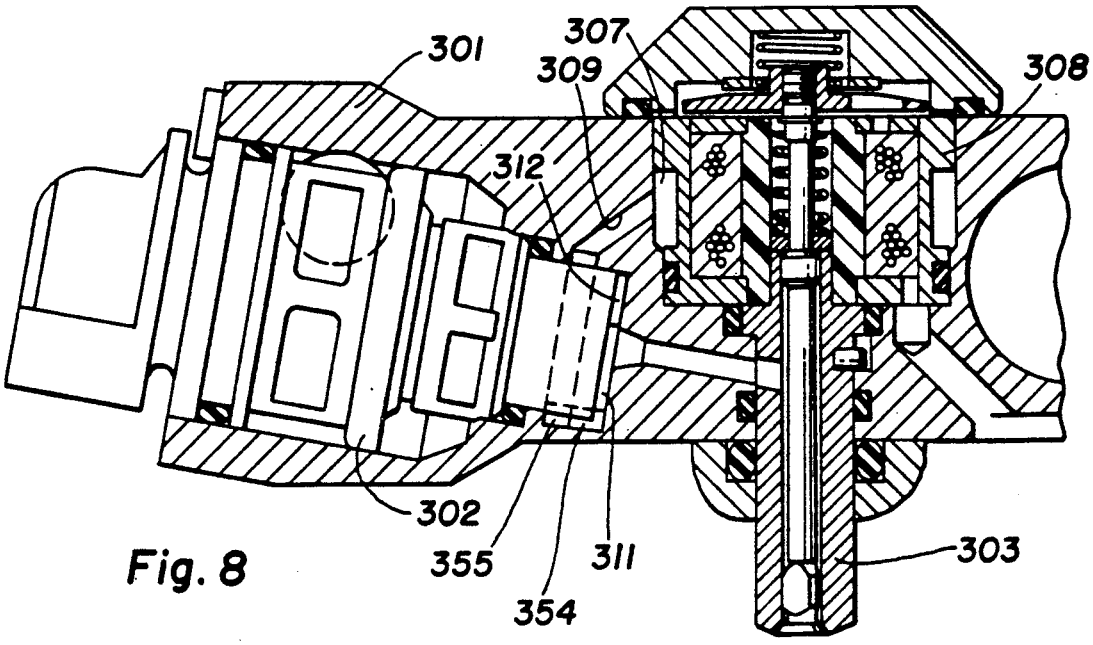
FIG. 8 is a section view similar to FIG. 1 of yet another fluid rail, showing another alternative air supply construction.

FIG. 8 illustrates yet another fluid rail body 301 in which an axially extending groove 354 and a peripherally extending groove 355 connect the air space 311 (at the end of the fuel metering injector 302) with the drilled air supply passage 309 that extends from the air supply channel 307 surrounding the housing 308 of the solenoid coil assembly in the charge delivery injector 303. As in the other embodiments, air space 311 is the wedge-shaped volume that is not occupied by the generally C-shaped elastomeric gasket 312 sandwiched between the end of fuel metering injector 302 and body 301. Other details of the FIG. 3 fluid rail assembly are similar to the other embodiments.

The constructions of FIGS. 6–8 further inhibit the back flow of fuel to minimize the possibility that fuel might be transferred from the fuel metering injector associated with one combustion chamber to the charge delivery injector associated with another combustion chamber.

We claim:

1. A fluid rail assembly having a body supporting a fuel metering injector and a charge delivery injector, said body having a space between the end of said fuel metering injector and the body, said charge delivery injector including a charge delivery valve, a solenoid having an armature for operating said valve, a valve stem connecting said valve to said armature, and a nozzle received in said body, said nozzle surrounding said valve stem and having a lateral aperture opening into the region within said nozzle about said valve stem below said solenoid, said body having a passage extending from said space to said aperture, said fuel metering injector being adapted to deliver fuel through said space, said passage and said aperture to said region within said nozzle, and said body including a passage for supplying air to said space to assist delivery of fuel from said fuel metering injector to said nozzle.

2. The fluid rail assembly of claim 1 wherein said air supply passage has a restrictor to inhibit back flow of fuel therethrough.

3. The fluid rail assembly of claim 1 wherein at least a portion of the air supplied through said passages is circulated about the coil of said solenoid.

4. The fluid rail assembly of claim 1 wherein at least the major portion of the air supplied to said region is supplied through said passages.

* * * * *

UNITED STATES PATENT AND TRADEMARK OFFICE

CERTIFICATE OF CORRECTION

PATENT NO. : 5,036,824

DATED : Aug. 6, 1991

INVENTOR(S) : William C. Albertson, George E. Pospiech, Louis H. Weinand

It is certified that error appears in the above-identified patent and that said Letters Patent is hereby corrected as shown below:

Title page,[75] column 1, Inventors: change "George E. Pospiech" to -- Gerald E. Pospiech --.

Signed and Sealed this

Ninth Day of March, 1993

*Attest:*

STEPHEN G. KUNIN

*Attesting Officer*

*Acting Commissioner of Patents and Trademarks*